US011805823B1

(12) United States Patent
Browning

(10) Patent No.: US 11,805,823 B1
(45) Date of Patent: Nov. 7, 2023

(54) NATURAL BREAST AND CLEAVAGE ENHANCEMENT ANCILLARY DEVICE

(71) Applicant: Ellen L Browning, Vero Beach, FL (US)

(72) Inventor: Ellen L Browning, Vero Beach, FL (US)

( * ) Notice: Subject to any disclaimer, the term of this patent is extended or adjusted under 35 U.S.C. 154(b) by 0 days.

(21) Appl. No.: 16/792,393

(22) Filed: Feb. 17, 2020

(51) Int. Cl.
*A41C 3/12* (2006.01)
*A41C 3/00* (2006.01)

(52) U.S. Cl.
CPC ..... *A41C 3/005* (2013.01); *A41C 3/0028* (2013.01); *A41C 3/124* (2013.01)

(58) Field of Classification Search
CPC ..... A41C 3/144; A41C 3/148; A41C 3/005; A41C 3/0028; A41C 3/124; A41C 3/0071; A41C 3/0064; A41C 3/0092
USPC ..... 450/1, 36, 54–55
See application file for complete search history.

(56) References Cited

U.S. PATENT DOCUMENTS 817,020 A * 4/1906 Thompson
2,579,365 A * 12/1951 Conde ..... A41C 3/10 450/39
2,844,151 A * 7/1958 Lemons ..... A41C 3/10 450/53
4,100,621 A * 7/1978 Ettipio ..... A41D 10/00 2/114
7,407,429 B2 * 8/2008 Chen ..... A41C 3/065 450/81
9,011,201 B2 * 4/2015 Chen ..... A41C 3/065 450/81
9,713,350 B1 * 7/2017 Colburn ..... A41C 3/065
2013/0109276 A1 * 5/2013 Sporn ..... A41C 3/10 450/57
2014/0349550 A1 * 11/2014 Campbell ..... A41C 3/0021 450/60

(Continued)

*Primary Examiner* — Gloria M Hale

(57) ABSTRACT

A fully attachable and detachable ancillary adjustable or non-adjustable breast and cleavage enhancement device and method for attachment to the inside of a brassiere, bikini bathing suit top, stand-alone breast support garment or any breast covering apparatus to enhance the appearance and lift of the wearer's breasts and cleavage. This stand-alone ancillary device is comprised of a pair of breast enhancing and directing pads designed to be securely attached to a brassiere, bikini bathing suit top, stand-alone breast support garment or any breast covering apparatus in a manner that will leverage pulling and pushing forces simultaneously to push breasts upward and towards each other increasing natural cleavage and generating the appearance of fuller breasts. This device provides the desired appearance of enlarged breasts and maximized cleavage in a way that is completely natural looking. The attachable device utilizes strategically placed attachment mechanisms for secure attachment to an existing brassiere, bikini bathing suit top, stand-alone breast support garment or any breast covering apparatus in conjunction with an optionally adjustable center connection mechanism. The strategically-placed attaching mechanisms and center connection device work together to channel pulling and pushing forces that push the breasts upward and together while minimizing unwanted movement of the device and of the breasts contained in the device.

1 Claim, 3 Drawing Sheets

(56) References Cited

U.S. PATENT DOCUMENTS

2015/0264982 A1* 9/2015 Randall ..... A41C 3/0057
450/52

* cited by examiner

NATURAL BREAST AND CLEAVAGE ENHANCEMENT ANCILLARY DEVICE

CROSS-REFERENCE TO RELATED APPLICATIONS

The present application is a continuation of U.S. patent application Ser. No. 62/807,953, filed Feb. 20, 2019 from which priority is claimed, the content of this application is hereby incorporated by reference in its entirety.

The present invention, designed by Ellen L. Browning of Vero Beach, Florida is called Natural Breast and Cleavage Enhancement Ancillary Device. This application is a continuation of U.S. patent application Ser. No. 62/807,953, filed Feb. 20, 2019. The invention relates to breast support and enhancement devices, or more specifically, attachable and detachable natural breast and cleavage appearance enhancement devices ancillary to primary breast support garments or systems. In particular, this invention relates to a stand-alone attachable and detachable, adjustable or non-adjustable, ancillary device that allows a wearer to enhance the manner in which a brassiere, bikini bathing suit top, stand-alone breast support garment or any breast covering apparatus supports, positions, and displays natural breasts and cleavage. The attachable and detachable nature of this device allows a single unit to be moved from garment to garment. The particular intention of this device is to leverage the combination of tension (pulling) force with compression (pushing) force generated by strategic placement of attaching mechanisms (also referred to as hooks) on a pair of breast pads in a manner that not only increases the ability of the device to enhance and maintain the appearance of enlarged breasts and increased cleavage, but to do so in a manner that looks natural and remains in place even during physical activity.

BACKGROUND OF INVENTION

For centuries women have been looking for ways to enhance their natural appearance, including focus on the appearance of enlarged breast size. In recent years, myriad attempts at enhancing bust lines and increasing the perceived fullness and firmness of the breasts has led to the invention of padded brassieres, devices used to squeeze breasts together, padded inserts, faux inserts, and even surgical procedures. In spite of decades of attempts at generating prior art that actually enhances the appearance of enlarged breasts while simultaneously providing ample cleavage, surgical implants are really the only "product" to have produced this look. Perhaps the failure of prior art to successfully enhance the appearance of enlarged breasts and cleavage simultaneously is in that in their typical embodiments, prior art provides either a "padded" look or a "squeezed cleavage" look, and typically, not at the same time. A "padded look" can definitely enhance the appearance of enlarged breasts under a shirt or dress that covers the cleavage line, however, that look does not translate well in shirts, dresses, and/or in bikini bathing suits that show cleavage. Take for example, U.S. Pat. No. 7,871,305 B2 which relates to enhanced push up bra construction and promises a push up brassiere that offers "full bust and cleavage enhancement. Regrettably, while wearing even a superiorly constructed padded and/or push up bra under a shirt or dress may look great and fool just about anyone into thinking that the wearer has enlarged breasts, cleavage, if showing, often appears out of proportion to the "padded" breasts. The reason for this is twofold. First, the padding typically serves only to add "volume in place" in that it pushes the bra and clothing out more while the breasts typically remain in an unenhanced position. Couple this critical limitation with current breast enhancement devices that lack the combination and leveraging of external forces in a manner capable of holding "positioned breasts" in place and you have a design that is not only a dismal failure, but is often counter-productive to the goal of generating the appearance of enlarged breasts. In fact, often times when a woman with smaller cups sizes (A and B cups) wears a padded brassiere with a garment that shows off the cleavage line (i.e., a "V-neck"), there exists frequently a gap between the bra and breasts that highlights the use of a padded brassiere more than it highlights the appearance of enlarged breasts.

Conversely, brassiere's or attachable devices that target an increase in cleavage by way of adjustable tension straps such as U.S. Pat. No. 3,196,878 (1965) and U.S. Pat. No. 6390884 B1 (2002) utilize front connectors and/or adjustable clips to cause breasts to squeeze together laterally. Sometimes, when adjustable connectors are part of an existing brassiere, the compressive force required to move the breasts together is minimized by limitations in the ability of the existing brassiere cups to move. Similarly, it's difficult if not impossible to attach a "pull together" mechanism to an existing brassiere and expect successful cleavage gain. This is because the pull generated on the bra cups by the addition of a center tension strap moves the bra cups inward and thus reduces the tension the brassiere places on the external portion of the breasts.

Some prior art, such as the Cinch Bra System and Method (US 20130109276) utilize a combination of adjustable shoulder straps and center tension straps to generate both upward "lift" and cleavage. In this method, upward "lift" can be achieved by tightening tension on a bra strap, but the upward "lift" is really upward "pull" on bra pads or bra cups causing the material to move along with the encased breasts. Not only can tightened shoulder straps be uncomfortable or even painful, this method does not actually "push" breasts into an uplifted and enhanced position, rather it pulls them upwards in conjunction with movement of "cups". When this movement occurs, the upward movement of the bra pads or breast cups lessens the compression load available for the center tension straps to utilize for lateral compression because of a counter-balance in tension and compression forces. This impact is greatest for smaller breasts.

Women are not only looking to improve their appearance by enhancing the appearance of enlarged breasts and abundant cleavage, for many women a full-figured bosom instills confidence. Yet, confidence in existing products is shaky at best as most women are aware of the perils that wearing padded inserts and using attachable devices can bring. Much of the prior art currently available is incapable of sustaining the positioning of enhanced breasts and/or enhanced cleavage and/or remaining in place during wear not to mention uncomfortable or cumbersome. The potential hazards of displacement, falling out, and embarrassing and unintentional "displays" of such devices are even worse during the course of movement or activity by the wearer. Further, some prior art tends to be embarrassing to women if displayed during intimate activities.

In sum, there exists a need for a discreet, easy to use, securely attachable ancillary device that will effectively provide and maintain the appearance of significantly enlarged breasts and abundant cleavage. This invention, described in the next section, does all of those things.

SUMMARY OF THE INVENTION

The fully stand-alone attachable and detachable ancillary natural breast and cleavage enhancement device and method of the present invention includes a pair of ovular, circular, tear-dropped, or any suitably shaped breast-lifting and enhancing pads suitable for placement in a brassiere, bikini bathing suit top, stand-alone breast support garment or any breast covering apparatus. The pair of enhancing pads are connected by a center mechanism which may or may not be adjustable. A minimum of two hooks per enhancement pad (minimum of 4 per device) are attached to the bottom, side, or top of each breast pad enabling the device to be secured in place to both sides of the inside of a brassiere, bikini bathing suit top, stand-alone breast support garment or any breast covering apparatus. The strategic placement of the hooks on each pad leverages the forces of tension (i.e., pulling force) created by the hooks on the top or side and bottom of each pad combined with compression (i.e., pressing together) created by a center mechanism. When the hooks and center mechanism are in place, the device holds breasts in an enhanced uplifted position and a squeezed together position simultaneously therein creating the appearance of fuller natural breasts and ample natural cleavage.

DETAILED DESCRIPTION OF THE INVENTION

Figure 1:
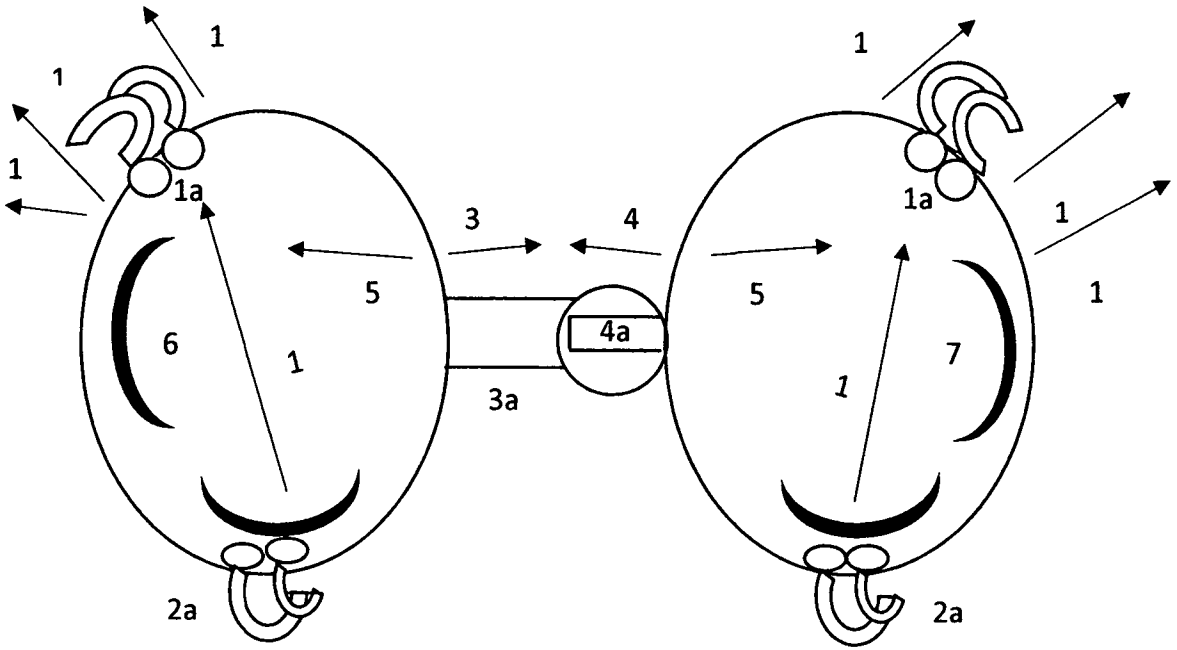
FIG. 1, FIG. 2, and FIG. 3 include front views of the stand-alone attachable and detachable adjustable or non-adjustable breast and cleavage enhancement ancillary device showing the minimum four attachment points with hooking means and center mechanism along with the resulting puffing and pushing forces that are generated by the combined use of the hooking means and center mechanism.
Figure 2:
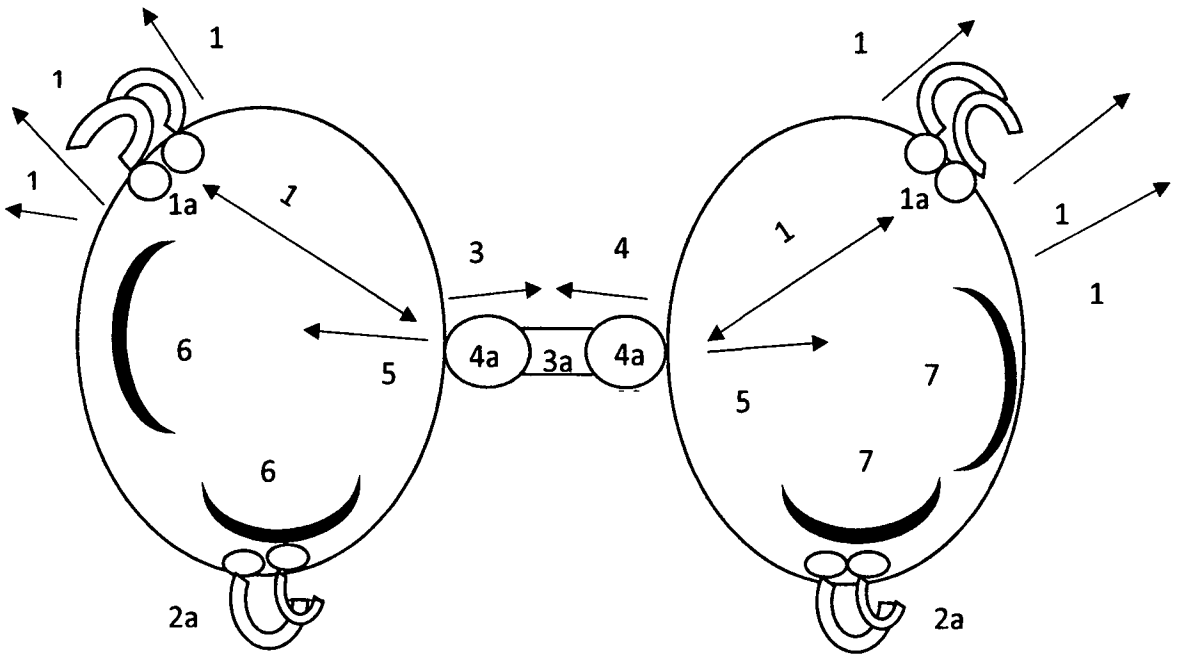
Figure 3:
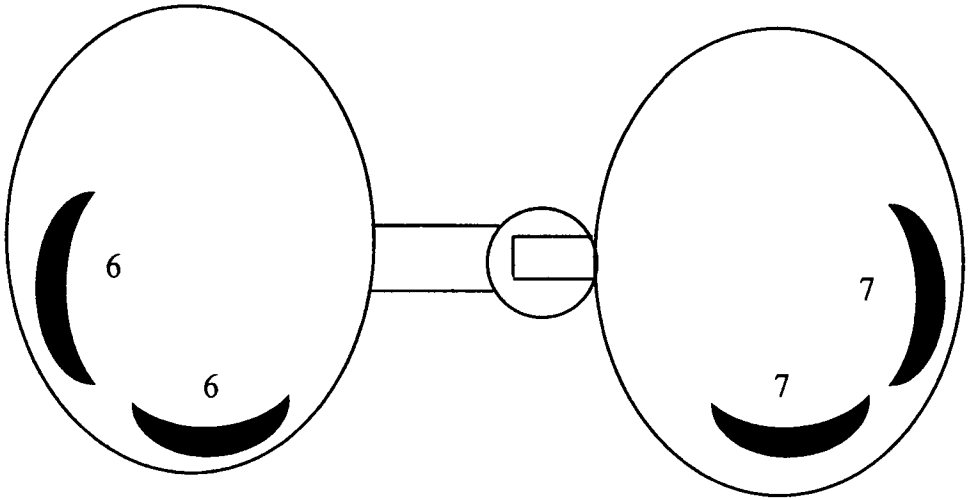

This invention improves upon existing, pending, and expired prior art by applying simple physics to the design, construction, and methodology of the device. Instead of utilizing adjustable shoulder straps and/or combinations of multiple brassieres to create uplift and cleavage, this device shown in FIG. 1 combines tension or pulling forces 1 and 5 and compression forces 3 and 4 by utilizing strategic placement of simple-to-use attachment mechanisms 1*a* and 2*a* and an adjustable or non-adjustable center mechanism 3*a* and 4*a*.

First, the main body of the device comprised of a pair of breast-lifting and enhancing pads 6 and 7 constructed of multi-layered polyfill, polyurethane foam, or other appropriate material with a tricot knit cover or other materials similar in nature and durability may be connected in the center by an adjustable or non-adjustable connecting mechanism 3*a* comprised of any appropriate material including cloth, metal, stone, plastics, etcetera or direct attachment. The fully stand-alone ancillary device will be attachable and detachable to any brassiere, bikini bathing suit top, stand-alone breast support garment or any breast covering apparatus by means of strategically placed adjustable or non-adjustable hooking mechanisms 1*a* and 2*a*. The hooking mechanisms 1*a* and 2*a* may include any hook, snap, button, catch or other means capable of attaching one artifact to another. In its preferred embodiment, the first pair of hooking mechanisms 1*a* will be placed between 10 and 40 degrees above the mid-point on the top, outer facing section of each pad. Exact placement of the hooking means on the invention and on the garment it is being attached to may vary with alternative embodiments and the type of hooking means utilized. The hooking means, 1*a* will be placed onto a brassiere, bikini bathing suit top, stand-alone breast support garment or any breast covering apparatus at the edges of each cup of the bra body in a position deemed to create the appropriate tension or pulling force. Secondly, the device will be attached to the bottom of each cup of a brassiere, bikini bathing suit top, stand-alone breast support garment or any breast covering apparatus by a hooking means 2*a*. After hooking the device in place using the hooking mechanisms 1*a* and 2*a*, manual positioning of the breasts within the breast enhancing and directing pads to the desired enhancement level will occur. Next, the optional adjustable mechanism 3*a* may be adjusted to individual preference in a manner that allows the breasts to move closer together. In the pictured embodiment, tightening and securing of a center tension strap 3*a* and catch device 4*a* creates lateral compression on the breasts causing them to move together creating enhanced cleavage, the breast pads 6 and 7 remain in a firmly fixed position within the bra body due to the tension or pulling forces created by the hooking mechanisms 1*a* and 2*a*. In that the breast pads 6 and 7 remain in a static position, the enhanced position of the breasts and cleavage remain securely in place while cleavage is greatly enhanced due to the added compression capability created by tension stress (or pulling in opposite directions) created by the hooking means 1*a* and 2*a*.

I claim:

1. A method for supporting a wearer's breasts and enhancing cleavage with a breast support and cleavage enhancement device comprising:

providing a breast support and cleavage enhancement device having two adjacent breast support pads with medially located pad connector means on medial sides of each pad;

said pad connector means including an adjustable hook and loop fastener;

said breast support pads each including a hook connector on a top half of each pad and a hook connector on a bottom half of each pad; and positioning said breast support device on an inside of any of a brassiere, bikini top or breast supporting garment wherein both breast support pads are attached to a top and bottom halves or edges of the garment using said hooks;

said pad adjustable connector on said medial sides of said adjustable pads provide an upward pull on the bottom halves of the breast support and enhancement device thereby increasing breast uplift while also increasing cleavage by compressing the breasts inward and closer together.

* * * * *